US006899088B2

(12) United States Patent
Djordjevic

(10) Patent No.: US 6,899,088 B2
(45) Date of Patent: May 31, 2005

(54) FLOW INTENSIFIER FOR COLD STARTING GASOLINE DIRECT INJECTION ENGINE

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/344,837

(22) PCT Filed: Aug. 13, 2001

(86) PCT No.: PCT/US01/25214

§ 371 (c)(1),
(2), (4) Date: Jul. 10, 2003

(87) PCT Pub. No.: WO02/14685

PCT Pub. Date: Feb. 21, 2002

(65) Prior Publication Data

US 2004/0011332 A1 Jan. 22, 2004

Related U.S. Application Data

(60) Provisional application No. 60/234,066, filed on Sep. 20, 2000.

(51) Int. Cl.[7] ..... F02M 33/04

(52) U.S. Cl. ..... 123/510; 123/511; 123/456; 123/446

(58) Field of Search ..... 123/456, 446, 123/447, 510–511

(56) References Cited

U.S. PATENT DOCUMENTS 4,449,507 A * 5/1984 Mayer ..... 123/467
4,667,638 A * 5/1987 Igashira et al. ..... 123/446
5,355,856 A * 10/1994 Paul et al. ..... 123/446
5,546,912 A * 8/1996 Yamada et al. ..... 123/511
5,884,597 A * 3/1999 Hiraku et al. ..... 123/179.17
6,073,597 A * 6/2000 Harata et al. ..... 123/179.14
6,415,770 B1 * 7/2002 Kojima ..... 123/511
6,637,408 B2 * 10/2003 Djordjevic ..... 123/456
6,776,138 B2 * 8/2004 Mahr et al. ..... 123/446
6,786,205 B2 * 9/2004 Stuhldreher et al. ..... 123/495

FOREIGN PATENT DOCUMENTS

JP 09250426 * 9/1997 ..... F02M/55/00
JP 20002976674 * 10/2000 ..... F02D/41/06

* cited by examiner

*Primary Examiner*—Thomas Moulis
(74) *Attorney, Agent, or Firm*—Alix, Yale & Ristas, LLP

(57) ABSTRACT

In a common rail gasoline fuel injection system having a high pressure fuel supply pump (14) in which fuel is pressurized in a pumping chamber and delivered through a high pressure passage (16) to the common rail (18), the improvement comprising a flow volume intensifier (22) situated in the high pressure passage (16). Preferably the intensifier has a cranking configuration in which a primary piston (32) of relatively low effective cross sectional area on which only the primary pressure of the pumping chamber is imposed, and a secondary piston (44) contacting the primary piston (32) and having a relatively large effective cross sectional area on which only the common rail pressure is imposed, whereby when the primary piston (32) is displaced a primary volume toward the secondary piston (44) by the primary pressure from the pumping chamber, the secondary piston (44) displaces a secondary volume of fuel into common rail (18) that is larger said primary volume.

11 Claims, 3 Drawing Sheets

Pre-pressurizing position: pump supplied sufficient fuel quantity (F.E. 1000 mm3) to reach 50 bar rail pressure Additional fuel quantity is supplied at reduced pressure (F.E. 4900 mm3) until normal operating position is reached After normal operating position was reached, full pumping pressure is available for injection (shown above)

FLOW INTENSIFIER FOR COLD STARTING GASOLINE DIRECT INJECTION ENGINE

This application claims priority under 35 USC §119(e), from U.S. Provisional Application No. 60/234,066 filed Sep. 20, 2000.

BACKGROUND OF THE INVENTION

The present invention relates to fuel injection systems for vehicle engines, and more particularly to common rail gasoline direct injection systems.

The design of the high pressure fuel pump for such common rail direct injection systems requires a number of trade-offs. For example, whereas the maximum required fuel delivery rate while the vehicle is under way can readily be accomplished with a modestly sized pump, the demands for a cold engine start require a delivery rate on the order of three times higher than the maximum needed for travel. As a consequence, conventional pumps are considerably oversized relative to the fuel delivery demands experienced during over 95 per cent of the engine operating time.

SUMMARY OF THE INVENTION

Recognizing that the very high fuel delivery rate is needed for only a short period (a few seconds) during even the most severe cold start condition, the present inventor has solved this design problem not by oversizing the pump, but rather by incorporating an inline flow volume intensifier into the system. The intensifier can be either a stand-alone unit or it can be incorporated into the pump or into the rail.

Preferably the intensifier has a cranking configuration in which a primary piston of relatively low effective cross sectional area on which only the primary pressure of the pumping chamber is imposed, and a secondary piston contacting the primary piston and having a relatively large effective cross sectional area on which only the common rail pressure is imposed, whereby when the primary piston is displaced a primary volume toward the secondary piston by the primary pressure from the pumping chamber, the secondary piston displaces a secondary volume of fuel into the common rail that is larger said primary volume. The intensifier transitions from the cranking configuration to a normal operating configuration when the secondary piston has been displaced to a limit position. In the normal operating condition, a fluid connection of the high pressure fuel in the pumping chamber is effectuated with the fuel in the common rail

DESCRIPTION OF THE PREFERRED EMBODIMENTS

Figure 1:
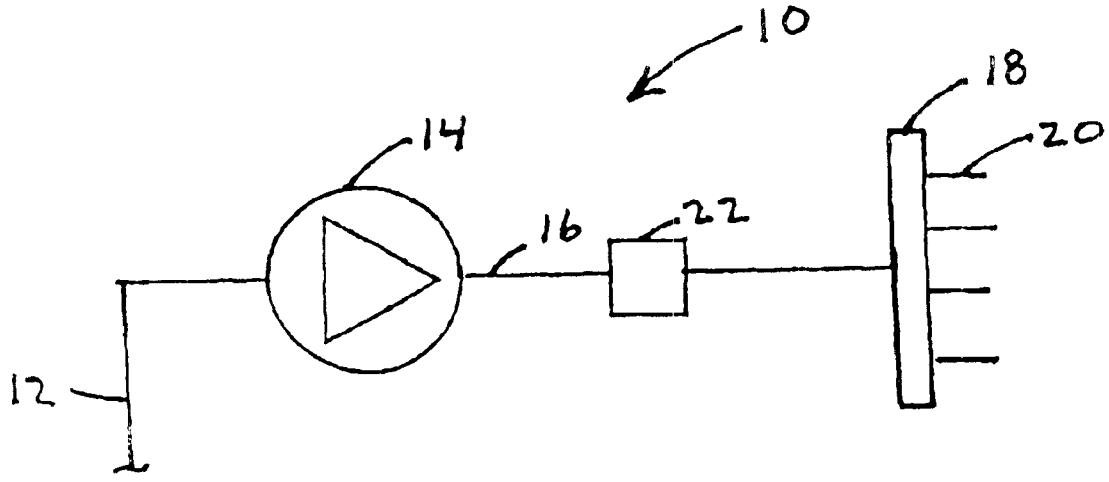
FIG. 1 is a schematic of a portion of a common rail fuel injection system, with the flow volume intensifier according the invention, situated in series with the high pressure pump, in the high pressure line to the common rail.

FIG. 1 is a schematic of a portion 10 of a gasoline common rail direct injection system, having a low pressure fuel feed line 12 delivering fuel to a high pressure pump 14. While the vehicle is underway during normal operation, the high pressure pump 14 and fuel line 16 maintain a pressure of, e.g., 120 bar or more, in the common rail 18, to which a plurality of injectors 20 are fluidly connected for injecting fuel into respective engine cylinders according to a control system (not shown). According to the preferred embodiment to be discussed in greater detail below, a flow intensifier 22 is situated in series with the pump 16, in the high pressure line 16.

Known plunger type pumps such as indicated at 14 can generate 120 bar pressure in a very short time, even at low R-PM. As only about 50 bar is needed to start a cold engine, the 120 bar pressure of the pump can be reduced in the intensifier 22, in exchange for gaining an inversely higher flow volume to the rail 18.

Figure 3:
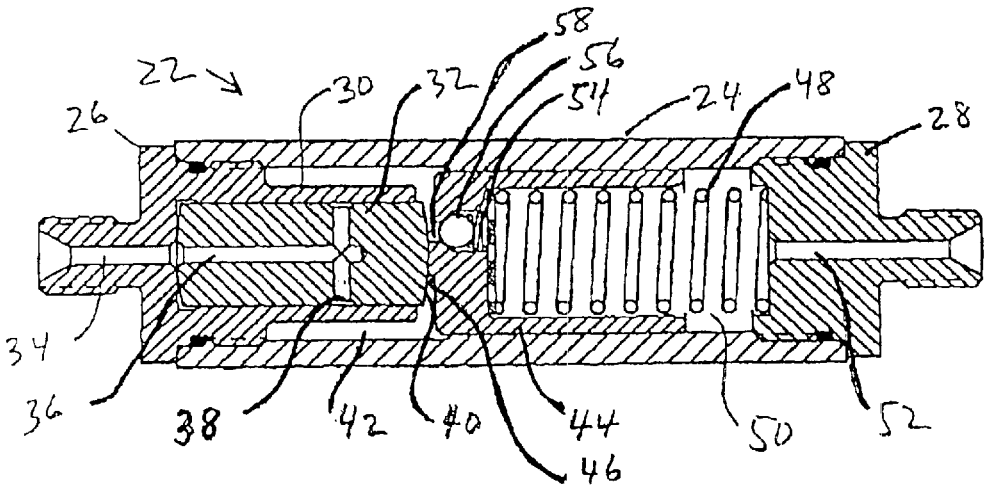
FIGS. 2 and 3 show one hardware implementation of the intensifier unit according to invention.
Figure 2:
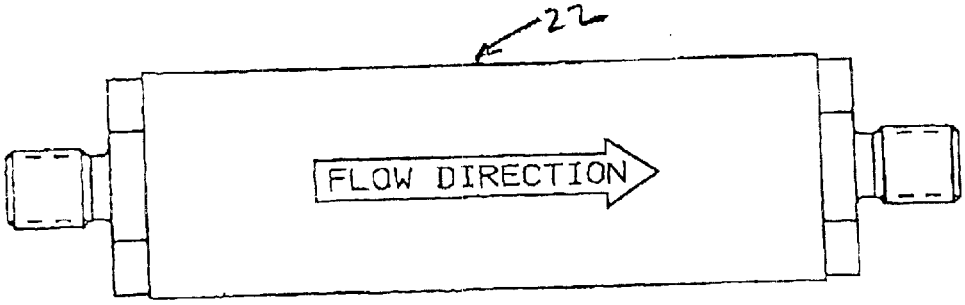

FIGS. 2 and 3 show one possible implementation of this inventive concept. The intensifier unit 22 comprises a tubular housing 24 having an inlet cap 26 sealing one end and an outlet cap 28 sealing the other end. The inlet cap has an inwardly extending collar 30 forming a cylinder in which is disposed a primary piston 32. An inlet passage 34 extends through the cap 26, for fluid communication between the line 16 from the high pressure pump 14 and the cylinder 30 and thus against one end face of the piston 32. Another passage 36 extends axially part way through the piston 32, and then extends radially to ports 38 spaced from the end face 40. The collar 30 preferably has an outer diameter that is well within the inner diameter of the housing 24, thereby defining an annular expansion chamber 42.

A secondary piston 44 has an end face 46 that abuts the end face 40 of the primary piston. This end face 46 is preferably formed with a nose or nipple, for reasons to be discussed below. The secondary piston 44 opens toward the end cap 28, thereby forming a seat for spring 48 and, with the surrounding portion of housing 24, defining an intensification chamber 50. A passage 28 through the end cap 52 fluidly connects the intensification chamber 50 with the fuel line 16 and common rail 18.

A check valve and associated spring 54, 56 are situated in conjunction is with a passage 58 extending between the face 46 of the secondary piston 44 and the intensification chamber 50. The optional nose or nipple in face 46 provides an offset for clearance between the passage 58 and end face 40 of the primary piston.

FIGS. 4–7 show the intensifier unit 22 in various phases of operation. In these figures, the expansion chamber 42' and the nose on face 46 of the secondary piston are diminished. A thickened portion of the housing forms the cylinder for the primary piston 32.

Figure 4:
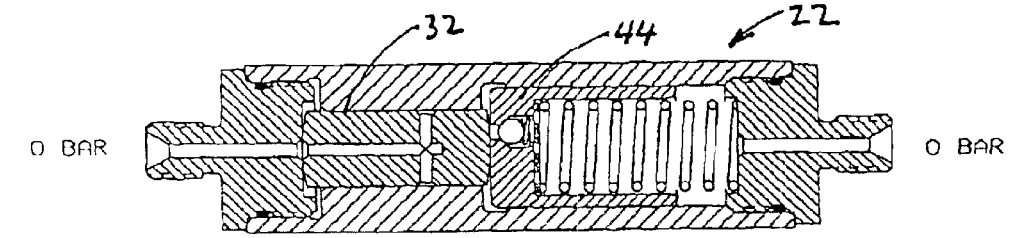
FIGS. 4–7 show the intensifier unit in various phases of operation.

FIG. 4 shows the unit after the vehicle has been standing unused for almost two weeks, whereupon the system has depressurized and the pressure in lines 12 and 16 has reached atmospheric (0 bar). However, line 16 and all passages and chambers in the unit 22 are full of fuel. The springs 48 and 54 are rather weak, being merely sufficient to maintain the configuration shown in FIGS. 3 and 4.

Figure 5:
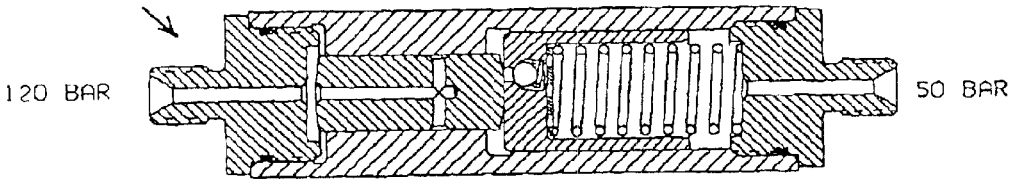

In FIG. 5, the pump has started and quickly establishes a pressure of 120 bar at the primary piston 32, thereby displacing the primary piston sufficiently (e.g., 1000MM3) to raise the rail pressure to, e.g., about 50 bar. According to FIG. 6, additional fuel quantity (e.g., 4900 nun3) is supplied to the rail at 50 bar by the secondary piston 44. The secondary piston travel displaces a higher volume of fuel at a lower pressure, thereby producing the desired flow intensification.

Figure 6:
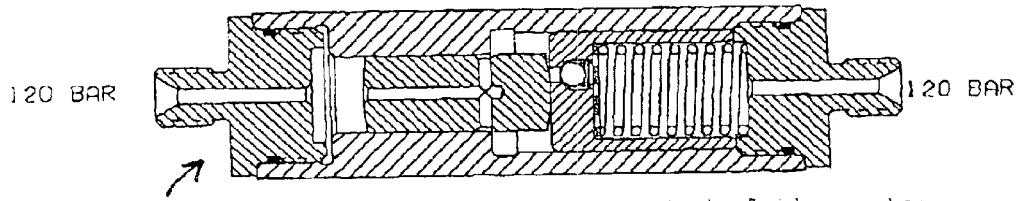

FIG. 6 shows the secondary piston bottomed out at the end cap after completing the intensification process. The primary piston 32 has been displaced such that the ports 38 reach the edge 60 of the structure defining the cylinder, thereby exposing the ports to the expansion volume 42'. As the secondary piston advances between the positions shown in FIGS. 4 and 6, the pressure in the expansion chamber 42' quickly reduces, but as the port 38 reaches the cylinder edge, fuel rapidly enters the chamber 42' at a very high pressure differential. For this reason, a larger expansion volume 42 such as shown in FIG. 3 is preferred, thereby reducing the pressure differential.

After the expansion chamber fills with fuel, the pressure at both ends of the unit equalize at 120 bar and the unit becomes transparent to the remainder of the system 10. Fuel flows through passages 34, 36, ports 38, chamber 42', through passage 58 against the weak check valve arrangement 54,56, into chamber 50 and out passage 52.

Figure 7:
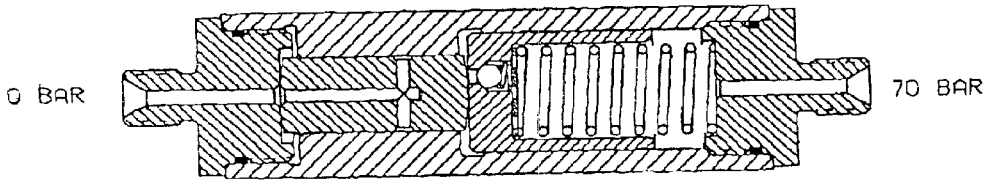

As shown in FIG. 7, after the pump 14 is stopped, the inlet pressure in passage 34 reduces to 0 bar and the rail pressure returns some fuel back to the intensifier, resetting the pistons to the position shown in FIG. 4. This also reduces the rail pressure, and therefor reduces the post-shutoff pressure buildup resulting from fuel expansion during heat soak.

During hot start the engine will start instantly on residual pressure present in the rail. As soon as the intensifier secondary piston bottoms out, full pumping pressure will be available for injection. This initial phase can extend well into the normal engine operation phase without any harm.

What is claimed is:

1. In a common rail gasoline fuel injection system having a high pressure fuel supply pump in which fuel is pressurized in a pumping chamber and delivered through a high pressure passage to the common rail, the improvement comprising a flow volume intensifier situated in the high pressure passage.

2. The system of claim 1, wherein the intensifier has a cranking configuration in which a primary piston of relatively low effective cross sectional area on which only the primary pressure of the pumping chamber is imposed, and a secondary piston contacting the primary piston and having a relatively large effective cross sectional area on which only the common rail pressure is imposed, whereby when the primary piston is displaced a primary volume toward the secondary piston by the primary pressure from the pumping chamber, the secondary piston displaces a secondary volume of fuel into the common rail that is larger said primary volume.

3. The system of claim 2, wherein the intensifier transitions from said cranking configuration to a normal operating configuration when the secondary piston has been displaced to a limit position, and means are effective in said normal operating condition for fluid connection of the high pressure fuel in the pumping chamber with the fuel in the common rail.

4. The system of claim 3, wherein the means for fluid connection comprise flow passages through the pistons, which fluidly connected only when the intensifier is in said normal operating configuration.

5. The system of claim 4, wherein the primary piston is a solid body having said flow passages extending axially from an end face opposite the secondary piston, then radially outward to a primary piston port, and the secondary piston has a solid face confronting the primary piston and an open, hollow body extending toward said stop limit, with said passage extending through said solid face.

6. The system of claim 5, wherein a one-way valve is provided in said flow passages.

7. The system of claim 5, wherein the primary piston is displaceable within a collar having an edge spaced from the solid face of the secondary piston, such that as the secondary piston reaches said stop limit, the port on the primary piston passes said edge and fuel from the pumping chamber enters said space, and passes through the solid face of the secondary piston.

8. The system of claim 7, wherein a one way valve is provided in the passage through the solid face of the secondary piston.

9. The system of claim 1, wherein the intensifier has a cranking configuration of pistons in which a primary volume of fuel pumped into the intensifier at a high pressure acts on a primary piston such that a greater volume of residual fuel associated with a secondary piston is discharged from the intensifier to the common rail at a lower pressure, and a normal operating configuration in which all the fuel pumped into the intensifier at high pressure is discharged from the intensifier to the common rail at substantially the same pressure.

10. The system of claim 9, wherein the high pressure pump delivers high pressure fuel to the intensifier at a pumping pressure above 100 bar and during the cranking configuration the intensifier delivers fuel to the common rail at a pressure less than about one-half the pumping pressure.

11. The system of claim 9, wherein the high pressure pump delivers high pressure fuel to the intensifier at a pumping pressure above 120 bar and during the cranking configuration the intensifier delivers fuel to the common rail at a pressure no greater than about 50 bar.

* * * * *